US012545452B2

(12) United States Patent
Secchiari et al.

(10) Patent No.: US 12,545,452 B2
(45) Date of Patent: Feb. 10, 2026

(54) WRAPPER MACHINE FOR PACKAGING FLEXIBLE ARTICLES WITH AN ELONGATED SHAPE, IN PARTICULAR FLEXIBLE HOSES

(71) Applicant: SICA S.P.A., Alfonsine (IT)

(72) Inventors: Marco Secchiari, Alfonsine (IT); Maurizio De Vita, Alfonsine (IT); Giovanni Vecchi, Alfonsine (IT); Andrea Gasperoni, Alfonsine (IT)

(73) Assignee: SICA S.P.A., Alfonsine (IT)

( * ) Notice: Subject to any disclaimer, the term of this patent is extended or adjusted under 35 U.S.C. 154(b) by 0 days.

(21) Appl. No.: 18/975,904

(22) Filed: Dec. 10, 2024

(65) Prior Publication Data

US 2025/0197043 A1 Jun. 19, 2025

(30) Foreign Application Priority Data

Dec. 14, 2023 (IT) ..... 102023000026706

(51) Int. Cl.
*B65B 25/24* (2006.01)
*B65B 11/02* (2006.01)
*B65B 63/04* (2006.01)

(52) U.S. Cl.
CPC ..... *B65B 11/025* (2013.01); *B65B 25/24* (2013.01); *B65B 63/04* (2013.01)

(58) Field of Classification Search
USPC ..... 53/203
See application file for complete search history.

(56) References Cited

U.S. PATENT DOCUMENTS

| | | | | |
|---|---|---|---|---|
| 4,281,500 | A | 8/1981 | Mueller et al. | |
| 2003/0097940 | A1* | 5/2003 | Mazzoni | B65B 27/06 100/2 |
| 2009/0308267 | A1* | 12/2009 | Song | B21C 47/24 100/29 |
| 2013/0168485 | A1* | 7/2013 | Balzanelli | B65H 54/58 242/472.5 |
| 2017/0174372 | A1* | 6/2017 | Quinones | B65B 11/004 |
| 2018/0141687 | A1* | 5/2018 | De Vita | B65B 11/045 |

FOREIGN PATENT DOCUMENTS

| | | | |
|---|---|---|---|
| CN | 218198951 | U | 1/2023 |
| EP | 1 074 473 | A1 | 2/2001 |
| EP | 3 292 045 | B1 | 5/2019 |
| KR | 10-2020-0124052 | A | 11/2020 |
| WO | 92/26863 | A1 | 9/1996 |

OTHER PUBLICATIONS

Italian Search Report dated Jul. 1, 2024 from corresponding Italian Patent Application No. 202300026706, 7 pages.

* cited by examiner

*Primary Examiner* — Chinyere J Rushing-Tucker
(74) *Attorney, Agent, or Firm* — Ruggiero McAllister & McMahon LLC

(57) ABSTRACT

A wrapper machine has a coiling station for forming a coil of a flexible article with an elongated shape, a packaging station for wrapping a stretch film around the coil, and a transfer unit for transferring the coil from the coiling station to a packaging station, where the coil is wrapped in a stretch film and moved intermittently around a rotation axis by two holding jaws mounted to rotate due to the thrust of respective crank mechanisms connected with an electric motor via an interposed transmission shaft.

11 Claims, 5 Drawing Sheets

WRAPPER MACHINE FOR PACKAGING FLEXIBLE ARTICLES WITH AN ELONGATED SHAPE, IN PARTICULAR FLEXIBLE HOSES

CROSS-REFERENCE TO RELATED APPLICATIONS

This patent application claims priority from Italian patent application no. 102023000026706, filed on Dec. 14, 2023, the entire disclosure of which is incorporated herein by reference.

BACKGROUND OF THE DISCLOSURE

1. Field of the Disclosure

The present disclosure relates to a wrapper machine for packaging flexible articles with an elongated shape, in particular flexible hoses.

2. Description of Related Art

The present disclosure finds particularly advantageous use in the packaging of flexible hoses in plastic stretch film, to which the following discussion will make explicit reference without loss of generality.

In the field of packaging flexible hoses in plastic stretch film, it is known to provide a wrapper machine of the type comprising a coiling station for forming a coil of flexible hose; a feeding unit for feeding a continuous bar of flexible hose to the coiling station; a cutting device for separating the coil from the continuous bar; a packaging station for wrapping a stretch film around the coil; and a transfer unit for transferring the coil from the coiling station to the packaging station in a feeding direction which is transverse to a longitudinal axis of the coil itself.

The packaging station comprises a wrapper assembly mounted to rotate continuously around a first rotation axis parallel to the feeding direction and wrap the stretch film around the coil and a rotary clamp configured to rotate the coil intermittently around a second rotation axis transverse to the first rotation axis itself.

The rotary clamp has a pair of holding jaws and an operating device for moving the holding jaws around the second rotation axis.

Each holding jaw comprises an outer plate connected with the operating device to move around the second rotation axis, and an inner plate movable, with respect to the outer plate, parallel to the second rotation axis between a clamping position and a release position of the coil.

The operating device comprises, for each holding jaw, a respective actuating cylinder with an output rod connected to the outer plate of the holding jaw itself.

Since the holding jaws of the rotary clamp are moved around the second rotation axis by two actuating cylinders that are independent of each other, known wrapper machines of the type described above have certain drawbacks mainly resulting from the fact that the two actuating cylinders are unable to synchronize the movements of the two holding jaws around the second rotation axis with each other, causing the coil of hose to twist.

Known wrapper machines of the type described above have the additional disadvantages that: the output rods of the two actuating cylinders are movable with a reciprocating rectilinear motion and therefore imply a relatively slow operating cycle; adjusting the angle of rotation of the holding jaws around the second rotation axis implies the adjustment of the stroke of the output rods of the two actuating cylinders and, therefore, the stopping of the wrapper machine; the angle of rotation of the holding jaws around the second rotation axis can only be changed by stopping the wrapper machine and, therefore, the complete covering of the coil implies a relatively high number of operating cycles of the two actuating cylinders and, therefore, a relatively high consumption of stretch film; and the two actuating cylinders are unable to synchronize the movement of the two holding jaws around the second rotation axis with the movement of the wrapper assembly around the first rotation axis.

SUMMARY OF THE DISCLOSURE

The object of the present disclosure is to provide a wrapper machine for packaging flexible articles with an elongated shape, in particular flexible hoses, that is free from the drawbacks described above.

According to the present disclosure, a wrapper machine is provided for packaging flexible articles with an elongated shape, in particular flexible hoses, as claimed in the appended claims and described herein.

BRIEF DESCRIPTION OF THE DRAWINGS

The present disclosure will now be described with reference to the attached drawings, which show a non-limiting embodiment thereof.

DETAILED DESCRIPTION OF THE DISCLOSURE

Figure 1:
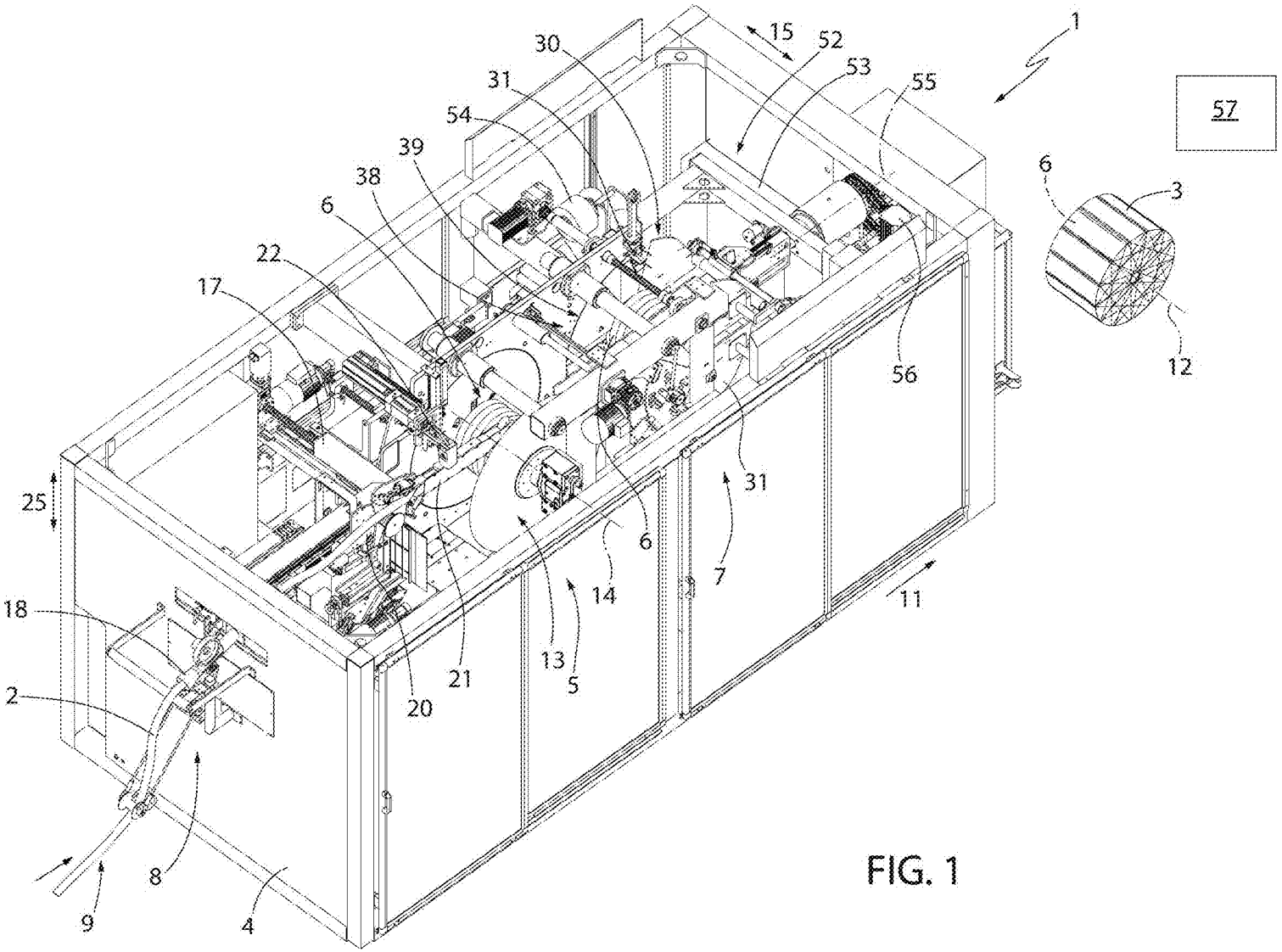
FIG. 1 is a schematic perspective view, with parts removed for clarity, of a preferred embodiment of the wrapper machine of the present disclosure.
Figure 2:
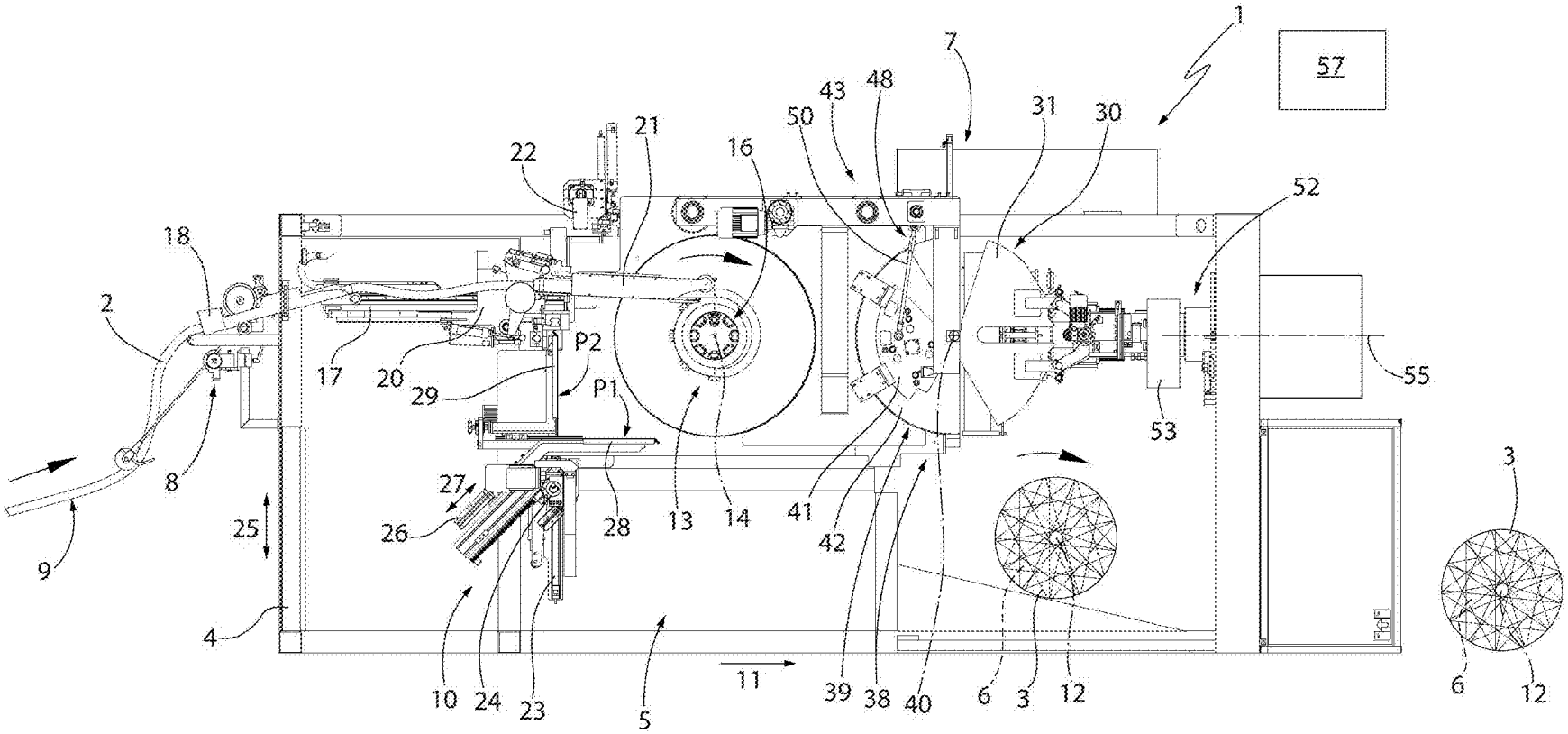
FIGS. 2 and 3 are two schematic side views, with parts removed for clarity, of the wrapper machine in FIG. 1.
Figure 3:
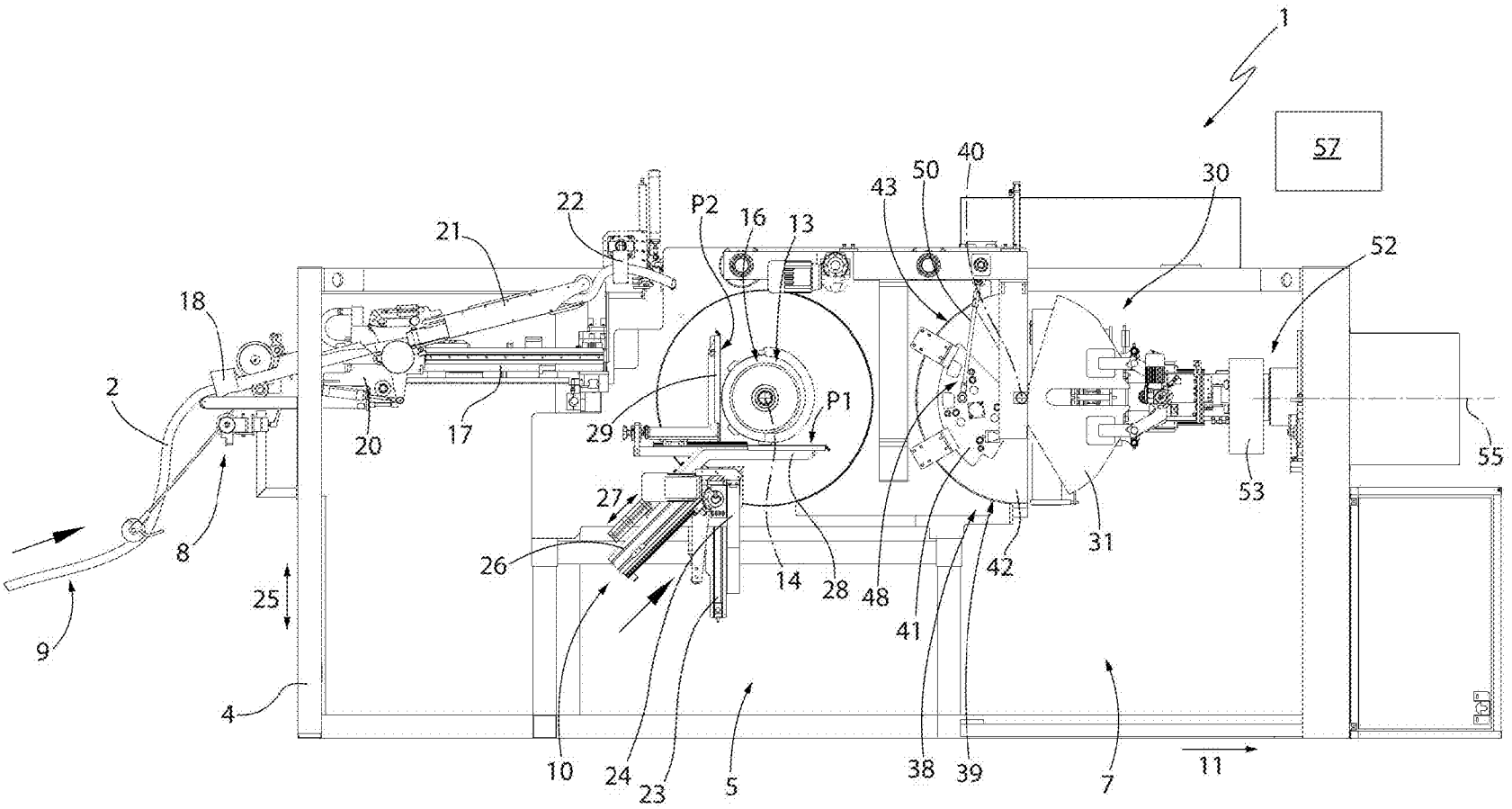

With reference to FIGS. 1, 2, and 3, reference numeral 1 denotes, as a whole, a wrapper machine for packaging hoses 2 in a stretch film 3 made of plastic material.

Machine 1 comprises an elongated base 4; a coiling station 5 of a known type for forming a coil 6 of hose 2; a packaging station 7 for wrapping the film 3 around the coil 6; a feeding unit 8 of a known type for feeding to station 5 a continuous bar 9 of hose 2 from an extrusion unit (not shown); and a transfer unit 10 for transferring coil 6 from station 5 to station 7 in a horizontal feeding direction 11 transverse to a longitudinal axis 12 of the coil 6 itself.

Station 5 is provided with a winder roller 13 of a known type, which is mounted to rotate about a longitudinal axis 14 parallel to a horizontal direction 15 transverse to direction 11, and is also mounted to make rectilinear movements in direction 15 between a forward formation position of coil 6 and a rearward disengagement position from coil 6 itself.

The roller 13 is bounded by an outer wall 16, which extends around axis 14, and is defined by a plurality of flat or cylindrical support sectors (not shown) movable transversely to axis 14 between an expanded position of formation of coil 6 and a contracted position of disengagement from coil 6 itself.

Feeding unit 8 comprises a first horizontal slide 17, which is slidably coupled to the base 4 to perform, with respect to the base 4 itself, rectilinear movements in direction 15, and supports an inlet cone 18 configured to receive the bar 9 of hose 2.

Unit 8 further comprises a second horizontal slide 20, which is slidably coupled to slide 17 to perform, with respect to slide 17 itself, rectilinear movements parallel to direction 11, and supports an extended guide arm 21, which protrudes from slide 20 in direction 11 to release hose 2 on roller 13.

Slide 17 also supports a cutting device 22 configured to separate coil 6 from bar 9 at the end of the formation cycle of coil 6 itself on roller 13.

Unit 8 is moved by slide 17 in direction 15 so that hose 2 is correctly and evenly distributed along axis 14 and then onto roller 13.

Transfer unit 10 comprises a horizontal slide 23 coupled to base 4 to perform, with respect to base 4 itself, rectilinear displacements in direction 11 between stations 5 and 7, a vertical slide 24 coupled to slide 23 to perform, with respect to slide 23 itself rectilinear movements in a vertical direction 25 orthogonal to directions 11 and 15, and an inclined slide 26 coupled to slide 24 to perform, with respect to slide 24 itself, rectilinear movements in a direction 27 inclined with respect to directions 11 and 25.

Slide 24 supports a lower bracket 28 defining a substantially horizontal support plane P1 for coil 6, and a rear plate 29, which defines a substantially vertical support plane P2 for coil 6, extends perpendicularly to direction 11, and is slidably coupled to slide 26 to perform, with respect to bracket 28 and during a tooling step of transfer unit 10, rectilinear displacements in direction 11 according to a diameter of coil 6.

Preferably, but not necessarily, plate 29 is moved along slide 26 in direction 11 by an operating device (not shown) comprising an electric motor with an output shaft connected to plate 29 itself.

At packaging station 7, coil 6 is advanced and released from transfer unit 10 within a containment channel 30 limited by two side walls 31 parallel to each other, each having the shape of a circular sector perpendicular to direction 15, and, moreover, having an amplitude of less than 180°.

Channel 30 is movable in direction 11 under the thrust of a known, non-illustrated actuating cylinder between a forward and a rearward position, and cooperates with a limit stop bar 32, which is mounted between walls 31 parallel to direction 15, and is slidably coupled to walls 31 to perform, with respect to walls 31 themselves, rectilinear displacements parallel to direction 11.

Figure 4:
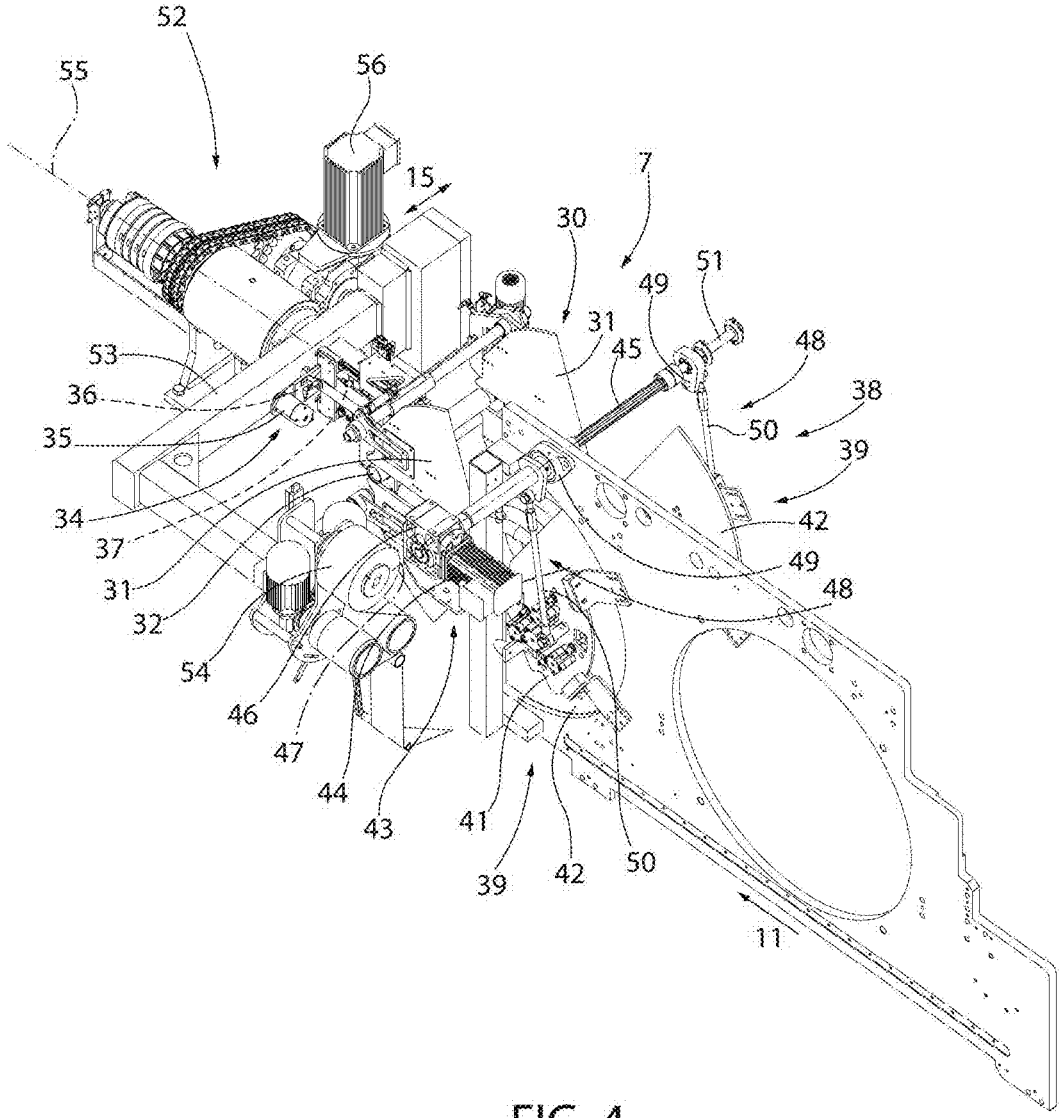
FIG. 4 is a schematic perspective view, with parts removed for clarity, of a detail of the wrapper machine in FIGS. 1, 2, and 3.
Figure 5:
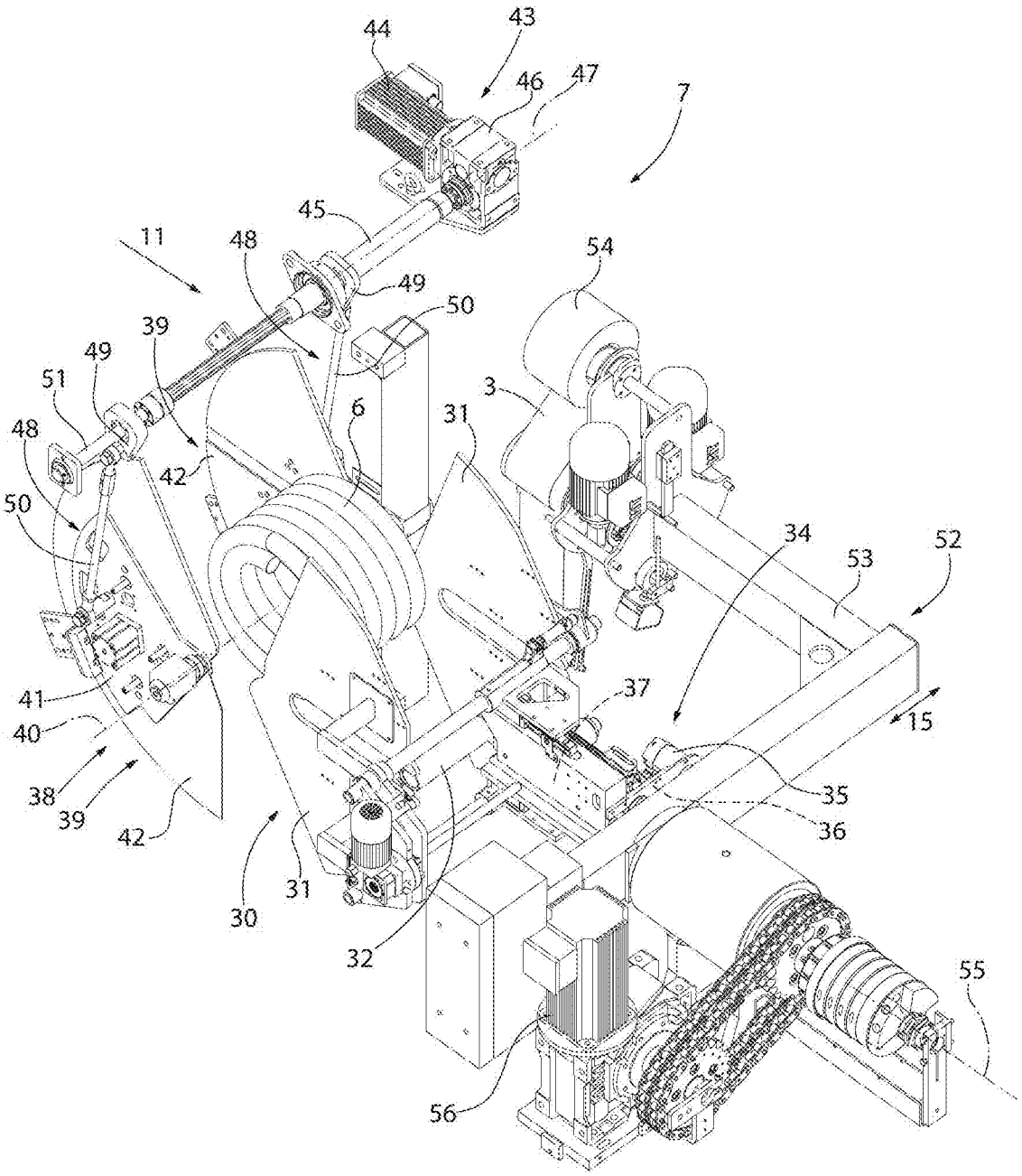
FIG. 5 is a schematic perspective view, with parts removed for clarity, of a detail from FIG. 4.

As shown in FIGS. 4 and 5, during a tooling step of packaging station 7, the position of bar 32 with respect to walls 31 is selectively controlled according to the diameter of coil 6 by an operating device 34 comprising an electric motor 35, an output shaft of which is coupled via a belt transmission 36 with a screw 37, which extends parallel to direction 11, and is coupled to bar 32 via a screw-nut screw coupling.

Channel 30 is aligned with a rotary clamp 38, which is mounted upstream of channel 30 in direction 11, and comprises two holding jaws 39 mounted to rotate alternatively about a rotation axis 40 parallel to direction 15.

Each jaw 39 is in the form of a circular sector perpendicular to direction 15, has, in addition, a width less than 180°, and comprises an outer plate 41 mounted to rotate about axis 40 and an inner plate 42 coupled to plate 41 in an angularly fixed manner to rotate about axis 40 and in a sliding manner to make, with respect to plate 41 itself, rectilinear movements in direction 15 between a clamping position and a release position of the coil 6.

Jaws 39 are moved around axis 40 by an operating device 43 comprising an electric motor 44 connected to a transmission shaft 45 via the interposition of a gear reducer 46.

Shaft 45 is mounted to rotate alternatively about its own longitudinal axis 47 parallel to direction 15, and is connected with plate 41 of each jaw 39 via a relative crank mechanism 48.

Each crank mechanism 48 comprises a crank 49 coupled to transmission shaft 45 in an angularly fixed manner and a connecting rod 50 coupled, in a rotary manner, on one side to crank 49 and on the other side to plate 41 of the relative holding jaw 39.

Shaft 45 has at least one telescopic section 51 axially movable along the axis 47 to selectively change the distance between jaws 39, during a tooling step of clamp 38, according to a width of coil 6 measured parallel to direction 15.

Packaging station 7 is further provided with a wrapper assembly 52 of a known type comprising a rotary arm 53, which is L-shaped, supports at least one coil 54 of film 3, and is mounted to rotate continuously about a rotation axis 55 parallel to direction 11 due to the thrust of an electric motor 56.

When containing channel 30 is arranged in its rearward position, arm 53 is moved by motor 56 around axis 55 to wind film 3 around coil 6.

Wrapper machine 1 also comprises an electronic control unit 57 connected to motors 44 and 56 and configured to: synchronize and time, relative to one another, electric motor 56 of arm 53 and motor 44 of clamp 38; selectively control the operation of motor 44 of clamp 38 to move shaft 45 with a reciprocating rotary motion around axis 47; selectively control the operation of motor 44 of clamp 38 and, therefore, the rotation of jaws 39 according to a diameter of coil 6; and selectively control the operation of motor 44 of clamp 38 and, therefore, the rotation of jaws 39 to cover the entire coil 6 with a relatively small number of layers of film 3.

The operation of the wrapper machine 1 will now be described from an instant when coil 6 of hose 2 is separated from bar 9 of hose 2 by cutting device 22, containing channel 30 is arranged in its forward position, and holding jaws 39 of rotary clamp 38 are placed in their release position.

Vertical slide 24 and inclined slide 26 of transfer unit 10 are raised to allow lower shelf 28 and rear plate 29 to engage coil 6, and horizontal slide 23 of transfer unit 10 is fed in direction 11 to move coil 6 from coiling station 5 to packaging station 7 and into containing channel 30.

At this point, holding jaws 39 of rotary clamp 38 are moved to their clamping position to hold coil 6, and containing channel 30 is moved to its rearward position.

Moving containing channel 30 to its rearward position allows rotary arm 53 of wrapper assembly 52 to rotate around axis 55 and wrap film 3 around coil 6.

During the wrapping of film 3 around coil 6, coil 6 is intermittently rotated by clamp 38 around axis 40 to allow wrapper assembly 52 to wrap the entire coil 6 with film 3.

Wrapper machine 1 has certain advantages mainly resulting from the fact that holding jaws 39 of rotary clamp 38 are driven by operating device 43, i.e., by a single operating device, to ensure proper synchronization of the movements of jaws 39 around axis 40 and homogeneous wrapping of successive coils 6.

In addition, electric motor 44 of operating device 43 enables electronic control unit 57 to synchronize and time motor 56 of arm 53 and motor 44 of clamp 38 with each other in order to: selectively control the rotation of coil 6 around axis 40 depending on the size of coil 6 and the number of layers of film 3 applied on coil 6 itself; guarantee wrapper machine 1 a relatively high productivity and a relatively low consumption of film 3; and avoid stopping wrapper machine 1 for tooling.

What is claimed is:

1. A wrapper machine for packaging flexible articles with an elongated shape, the wrapper machine comprising:

a coiling station for forming a coil of a flexible article with an elongated shape;

a packaging station for wrapping a stretch film around the coil; and a transfer unit for transferring the coil from the coiling station to the packaging station in a feeding direction that is transverse to a longitudinal axis of the coil;

wherein the packaging station comprises, in turn, a wrapper assembly mounted to continuously rotate around a first rotation axis that is parallel to the feeding direction and wrap the stretch film around the coil, and a rotary clamp that is configured to rotate the coil around a second rotation axis transverse to the first rotation axis and that is provided with a pair of holding jaws and with an operating device for moving the holding jaws around the second rotation axis, and wherein the operating device comprises an electric motor, a transmission shaft mounted to rotate, due to a thrust of the electric motor, around a third rotation axis parallel to the second rotation axis and, for each holding jaw, a respective crank mechanism for connecting the transmission shaft and the holding jaw to one another.

2. The wrapper machine according to claim 1, wherein each crank mechanism comprises a crank coupled to the transmission shaft in an angularly fixed manner and a connecting rod coupled, in a rotary manner, on one side to the crank and on the other side to the relative holding jaw.

3. The wrapper machine according to claim 1, further comprising:

an electronic control unit configured to selectively control the operation of the electric motor of the rotary clamp to move the transmission shaft with a reciprocating rotary motion around the third rotation axis.

4. The wrapper machine according to claim 1, wherein the transmission shaft comprises at least one telescopic segment that is axially movable to change the distance between the two crank mechanisms depending on a width of the coil measured parallel to the third rotation axis.

5. The wrapper machine according to claim 1, wherein each holding jaw comprises an outer plate that is connected to the relative crank mechanism and an inner plate that is movable relative to the outer plate between a clamping position and a release position for clamping and releasing the coil.

6. The wrapper machine according to claim 1, further comprising:

a feeding unit for feeding a continuous bar of flexible article to the coiling station; and a cutting device for separating the coil from the continuous bar of flexible article.

7. The wrapper machine according to claim 1, further comprising:

an electronic control unit connected to the operating device of the rotary clamp and configured to selectively control the operation of the electric motor and, hence, the rotation of the holding jaws based on a diameter of the coil.

8. The wrapper machine according to claim 1, wherein the transfer unit comprises a feeding slide comprising, in turn, a lower support plate defining a horizontal support plane for the coil, a rear support plate defining a vertical support plane for the coil, and an actuator device to move the rear support plate relative to the lower support plate and parallel to the feeding direction based on a diameter of the coil.

9. The wrapper machine according to claim 1, wherein the wrapper assembly comprises a rotary arm for a coil of stretch film and an electric motor to move the rotary arm around the first rotation axis, wherein the wrapper machine further comprises an electronic control unit configured to synchronize and time, relative to one another, the electric motor of the rotary arm of the wrapper assembly and the electric motor of the rotary clamp.

10. The wrapper machine according to claim 1, wherein the packaging station further comprises a containing channel that is arranged in front of the rotary clamp in the feeding direction to laterally contain the coil, wherein the containing channel is provided with a pair of side walls perpendicular to the second rotation axis, wherein the containing channel cooperates with a limit stop element mounted between the side walls parallel to the second rotation axis, and wherein the limit stop element is connected to an electric motor to selectively control the position thereof parallel to the feeding direction.

11. The wrapper machine according to claim 1, wherein the flexible articles are hoses.

* * * * *